United States Patent [19]

Willimzik

[11] 4,057,992

[45] Nov. 15, 1977

[54] MANDREL FOR COLD DRAWING AND/OR SIZING TUBES

[75] Inventor: Bernhard Max Willimzik, Mechernich-Katzvey, Germany

[73] Assignee: GRANGES NYBY AB, Sweden

[21] Appl. No.: 684,021

[22] Filed: May 7, 1976

[30] Foreign Application Priority Data

Apr. 9, 1976 Germany ..... 2615575

[51] Int. Cl.[2] ..... B21C 1/24

[52] U.S. Cl. ..... 72/283; 72/43; 72/478

[58] Field of Search ..... 72/283, 41, 43, 478, 72/479

[56] References Cited

U.S. PATENT DOCUMENTS

| | | | |
|---|---|---|---|
| 2,355,734 | 8/1944 | Katz | 72/283 |
| 2,408,325 | 9/1946 | Luce et al. | 72/283 |
| 3,783,663 | 1/1974 | Pravsnar et al. | 72/283 |
| 3,901,063 | 8/1975 | Nileshwar | 72/283 |
| 3,903,724 | 9/1975 | Alekhin et al. | 72/283 |

FOREIGN PATENT DOCUMENTS

| | | | |
|---|---|---|---|
| 698,689 | 10/1940 | Germany | 72/283 |
| 916,485 | 7/1949 | Germany | 72/283 |
| 585,844 | 11/1958 | Italy | 72/283 |
| 376,230 | 11/1939 | Italy | 72/283 |
| 206,512 | 6/1968 | U.S.S.R. | 72/283 |
| 298,400 | 5/1971 | U.S.S.R. | 72/283 |

*Primary Examiner*—Michael J. Keenan
*Attorney, Agent, or Firm*—Craig & Antonelli

[57] ABSTRACT

A mandrel, in particular a floating mandrel, for the cold drawing and/or sizing of tubes comprising a drawing portion and a shoulder portion section, wherein corresponding to the various functional requirements which are made of its different sections the mandrel consists of two or more different portions which are joined to form a resilient structure and comprise between them at least one intermediate space whose volume is variable by resilient deformation of the mandrel portions and/or relative movement of the mandrel portions with respect to each other, and is substantially completely sealable by engagement of the mandrel portions on the inner wall of the tube to be drawn.

20 Claims, 5 Drawing Figures

MANDREL FOR COLD DRAWING AND/OR SIZING TUBES

The present invention relates to a mandrel for cold drawing and/or sizing tubes.

The cold drawing or sizing of tubes is generally carried out by drawing a tube blank through a die or a drawing ring or gauge plate, a drawing mandrel simultaneously being introduced into the tube blank and the tube inner wall bearing on said mandrel during the drawing operation. To enable the drawing operation to be carried out at all the so-called working surfaces or working portions of the mandrel on which the tube inner wall bears must be supplied with lubricant, e.g. oil or the like. Similarly, lubricant, in particular oil, must be introduced between the drawing ring and the tube outer wall.

As a rule a mandrel consists of two sections, i.e. the highly stressed sizing or drawing portion and the less highly stressed and generally larger shoulder portion. The mandrel may be constructed as integral, i.e. undivided, body or may consist of a plurality of parts which are joined together rigidly via a central stud.

If it is desired to impart to such a mandrel a specific form, e.g. for drawing with oil, and thus to ensure the continuity of the lubricant film, difficulties are encountered in simultaneously achieving a functional shaping of the mandrel. Furthermore, such rigid mandrels have the disadvantage that they are subject to extremely high stresses which are often close to the strength limit of the material. These disadvantages are a great drawback both for the production and for the economy of cold drawing or sizing methods.

The problem underlying the present invention is to eliminate the disadvantages referred to and provide an improved mandrel, in particular an improved "flying" or "floating" mandrel which inter alia imparts to the drawing operation improved economy and with which the wear of the mandrel is greatly reduced and a permanent lubricating film ensured.

This problem is solved according to the invention in that corresponding to the various functional requirements which are made of its different sections the mandrel consists of two or more different portions which are joined to form a resilient structure and comprise between them at least one intermediate space whose volume is variable by resilient deformation of the mandrel portions and/or relative movement of the mandrel portions with respect to each other, and is substantially completely sealable by engagement of the mandrel portions on the inner wall of the tube to be drawn.

The mandrel according to the invention has the advantage of permitting a certain adaptation of the transition from the drawing portion to the shoulder portion to the particular drawing operation. Furthermore, the mandrel according to the invention has the advantage that due to the resilient structure and the variable intermediate space between the different mandrel portions on drawing the tube a slight oscillatory or vibrating movement of the different mandrel portions with respect to each other and/or with respect to the tube is made possible, thus ensuring a uniform distribution of the lubricant and a supply thereof to the stressed areas of the mandrel. As a result of the provision of an intermediate space between the various mandrel portions, in particular between the drawing portion and the shoulder portion, due to the axially slight reciprocal oscillatory movement of the shoulder portion the intermediate space constantly changes its volume and acts like a pump which pumps the oil which has penetrated into the intermediate space outwardly and in particular also into the gap between the drawing portion and the tube, thus improving the oil supply to the drawing portion, which is subjected to the highest stress, during the drawing operation.

In a preferred example of embodiment of the mandrel according to the invention the various mandrel portions are displaceable relatively to each other on a central stud and pressed against each other by a spring bias of the order of magnitude of the axial forces exerted on the mandrel portions during the drawing operation. The spring bias may be effected by means of cup springs and/or resilient shims. Advantageously, one of the mandrel portions, e.g. the drawing portion, is disposed fixedly on the stud, for example by means of a shrink fit or by screwing on, and a second mandrel portion, preferably the shoulder portion, is arranged for axial displacement on the stud with an exact fit providing a sealing sliding engagement. The sealing sliding fit is necessary to seal the intermediate space between the mandrel portions with respect to the stud and to ensure a pump action of said intermediate space during the aforementioned axial oscillatory or vibratory movements of the mandrel portions with respect to each other with an adequately high oil pressure. According to the invention it may be advantageous to make the shoulder portion of two or more sections disposed in series axially to enable the various sections to be made from different quality materials in accordance with the stresses to which they are subjected.

It may also be advantageous according to the invention to give the shoulder portion and/or the drawing portion a mirror-symmetrical form with respect to their radial centre plane so that these portions can be turned round and thus their life doubled.

Preferably, the drawing portion is provided with a cutting edge which has a contour differing from circular form, at least some portions of the cutting edge extending inclined to the radial centre plane of the drawing portion. This construction of the cutting edge has the advantage that a notching effect in the region of the cutting edge is substantially avoided, which of course occurs if a circular cutting edge is employed as is usually the case. This notching effect leads in known circular cutting edges, in particular at the start of the drawing operation, frequently to difficulties and can result not only in rough inner surfaces of the tube but even in tearing. It is particularly important to avoid a notching effect when the tube changes its direction as is the case for example with coil drawing. The obviation of the notching effect of the cutting edge of the drawing portion described is also an advantage with a straight draw because in the absence of the notching effect overcritical drawing conditions can be permitted.

According to the invention the notching effect may also be reduced by giving the chamfer adjoining the cutting edge of the drawing portion a very shallow angle to the mandrel axis. An angle between 33°, preferably between 25°, in particular between 10° and 20°, may be advantageous.

The invention will be explained hereinafter with the aid of the schematic drawings of examples of embodiment, wherein.

Figure 1:
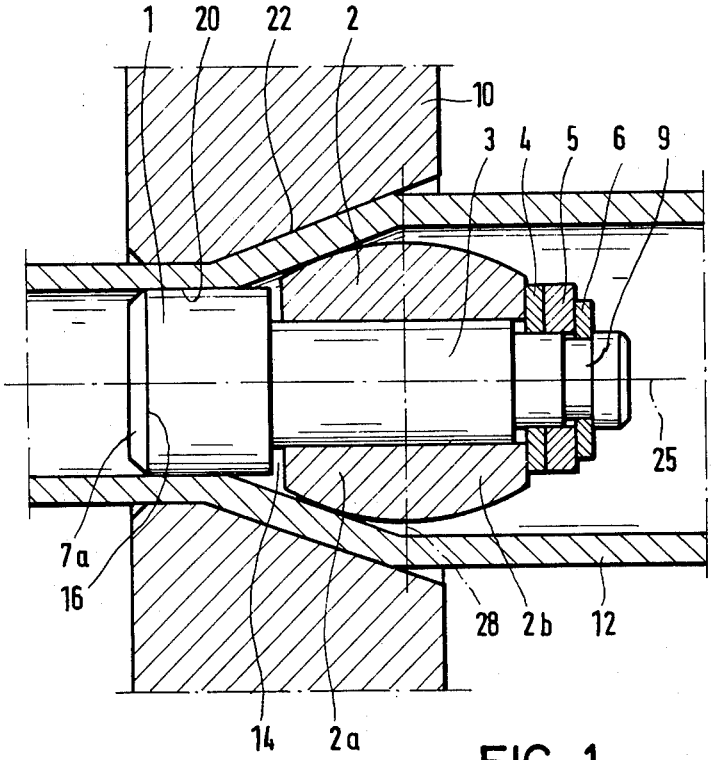
FIG. 1 shows a drawing mandrel in the working position in longitudinal section and FIG. 2 shows a portion of a drawing mandrel in side elevation.

FIG. 1 shows a drawing mandrel which cooperates with a die or a drawing ring 10 and is inserted into the interior of a tube blank 12, said mandrel being constructed as socalled "floating" or "flying" mandrel. The mandrel consists of a sizing cylindrical drawing portion 1 of highly wear-resistant material, preferably hard metal or hard-chromed tool steel, and a runup or shoulder portion 2 of material of lesser quality, for example high-strength alloyed steel or tool steel. The drawing portion 1 is fixedly connected to the support stud 3 whereas the shoulder portion 2 is arranged for reciprocal displacement on the support stud 3. It is however conversely possible to connect the shoulder portion 2 fixedly to the support stud 3 and mount the drawing portion 1 reciprocally displaceably on the support stud 3.

In the present case the nature of the connection between the drawing portion 1 and the support stud 3 is not apparent from the drawings. In general, the drawing portion 1 is shrunk onto the support stud 3. It may however be advantageous to provide the drawing portion 1 with an inner thread and screw said portion onto the support stud, which is provided with a corresponding outer thread. It may be advantageous to provide the cylindrical drawing portion 1 on both opposite end faces with an inner thread or with a continuous through inner thread so that the drawing portion 1 may conversely be screwed onto the support stud 3. This is of particularly great advantage when only the front half of the drawing portion cooperates with the tube inner wall, i.e. forms the working zone 20 of the drawing portion. By turning the drawing portion round the life thereof can then be doubled.

The drawing portion 1 may however also be secured to the support stud 3 by means of soldering, welding, pressing on or the like.

The support stud 3 may consist of a material which is not as hard, for example tool steel.

Inserted into an annular groove 9 at the end of the support stud 3 remote from the drawing portion 1 is a spring ring 6 which forms a stop on which the shoulder member bears via a spring element 4 and a spacer ring 5 on the support stud 3 during the drawing operation. The spring element 4, which is shown in FIG. 1 schematically as a ring, may for example consist of one or more cup springs or a ring of resiliently deformable rubber or plastic.

The resilient supporting of the shoulder portion 2 via the spring 4 on the support stud 3 permits a resilient taking-up of the stresses occurring during drawing of the tubes. Lubricant can collect in an intermediate space 14 formed between the drawing portion 1 and the shoulder portion 2, the resilient displacement of the shoulder portion 2 providing a pumping action which contributes to supplying lubricant to the support or drawing portion 1 and continuously maintaining a film of lubricant.

The nature and thickness of the spring 4 are chosen in dependence on the forces occurring during drawing, the drawing rate and the toughness of the material of the tube to be drawn.

Instead of the spring ring 6, the retaining means for the shoulder portion 2 on the support stud 3 may be a retaining nut, which is not illustrated, which is adapted to be screwed onto the end of the support stud 3 remote from the drawing portion 1. To avoid automatic slackening of the retaining nut during the drawing operation it may be locked by means of a second nut.

The use of a retaining nut has the advantage that by screwing said nut in to different extents the axial width of the intermediate space 14 and/or the biasing of the spring 4 is adjustable.

The drawing portion 1 illustrated in FIG. 1 comprises a cylindrical form and has at its free end a circular cutting edge 16 which is adjoined by a chamfer *7a*.

Figure 2:
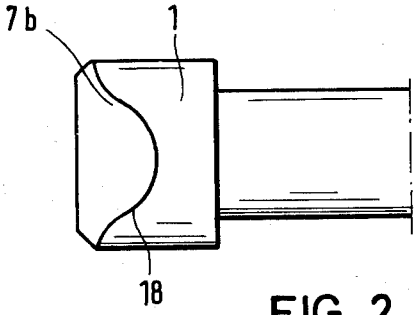

The cutting edge 16 of the drawing portion 1 may advantageously be merged into an undulated form, i.e. the form of the cutting edge may be adapted to the drawing operation by varying its geometrical shape. An embodiment of an undulated cutting edge 18 comprising a correspondingly adapted chamfer *7b* is illustrated in FIG. 2.

Figure 3:
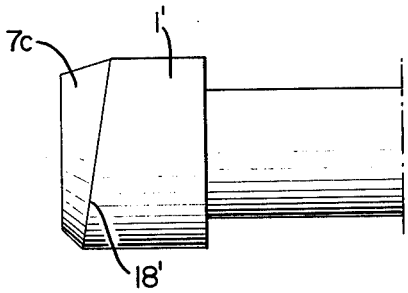
FIG. 3 shows a portion of a drawing mandrel according to a second embodiment in side elevation.

FIG. 3 illustrates an embodiment wherein the cutting edge 18' of drawing portion 1' comprises an oval form inclined with respect to the radial centre plane and having a corresponding chamfer *7c*.

To further reduce the notching action caused by the cutting edge 16 on the tube drawn it may also be advantageous to make the chamfer *7a, 7b* relatively flat, i.e. the angle of the chamfer *7a, 7b* to the stud axis 25 relatively small, for example between 3° and 30°, preferably between 3° and 20°, in particular 5° and 15°.

The shoulder portion 2 is fitted over the support stud 3 with an exact fit so that there is a substantially sealing sliding engagement between the support stud 3 and the shoulder portion 2 and no lubricant can escape between the support stud 3 and the shoulder portion 2. This is important for building up an adequately high lubricant pressure in the intermediate space 14.

As is apparent from FIG. 1 the shoulder portion 2 is replaceable, thus providing a universal mandrel. The drawing portion 1 and the support stud 3 may be used for a large number of drawing operations and the shoulder portion 2 may be adapted in simple manner to the initial dimensions of the die 10 and to the internal diameter and wall thickness of the tube 12 to be drawn. The invention makes it possible for the shoulder portion 2 to consist of material of lesser quality than the drawing portion because it is not subjected to stresses as high as those acting on the latter. It has in contrast hitherto been usual to make the shoulder portion of high quality material as well and generally it was made integral with the drawing portion.

The mandrel according to the present invention may of course be subjected to a great number of modifications. By making the shoulder portion 2 mirror-symmetrical with respect to its radial centre plane 28, the parts *2a* and *2b* thus being identical, it is possible to double the life by simple reversal since in each case only the front half is stressed.

The shoulder portion 2 may consist of a plurality of annular sections, high quality material being used at specifically stressed areas, in particular at the point at which the tube inner wall bears on the shoulder portion, the socalled working zone 22 of the shoulder portion, and cheap or simple material being used at the less stressed areas. This applies specifically to high mandrel diameters. A particular advantage also resides in that for at least partial sections of such shoulder portions materials may be used which were hitherto considered unsuitable for drawing mandrels, for example plastic bodies, hard rubber, hard wood, plastic laminate material, composite material, hard porcelain or the like. Material which in use supports the lubrication is particularly advantageous, as is for example the case if sintered material is used.

Figure 4:
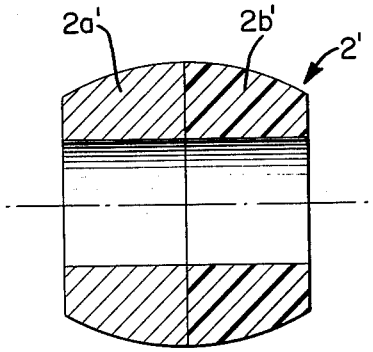
FIG. 4 shows a shoulder embodiment formed of two segments.
Figure 5:
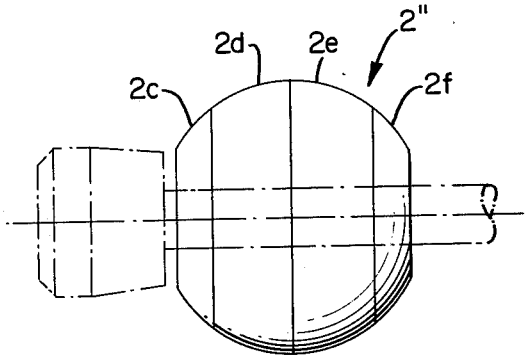
FIG. 5 shows a shoulder embodiment formed of four segments.

FIG. 4 shows a shoulder 21 consisting of two sections 2'a and 2'b lying axially in series with, by way of example, section 2'a being represented as being formed of metal while section 2'b is shown as a plastic or rubber like material. Similarly, FIG. 5 illustrates a shoulder embodiment 2'' composed of four sections 2c – 2f.

In the drawings and specification, there has been set forth preferred embodiments of the invention, and although specific terms are employed, they are used in a generic and descriptive sense only and not for purposes of limitation.

I claim:

1. A floating mandrel for the cold drawing and/or sizing of tubes comprising:

a drawing portion engageable with inside walls of a tube during drawing operations, a shoulder portion also engageable with inside walls of a tube during drawing operations, said shoulder portion being axially spaced from said drawing portion with its shoulder and drawing portions defining a lubricant space therebetween, said lubricant space being delimited in a direction transverse to the drawing axis of said mandrel by a tube being drawn when said mandrel is in an in-use drawing position, and movement accommodating means for accommodating relative axial movement of said drawing portion and said shoulder portion to thereby vary the volume of said lubricant space and create a pumping effect on lubricant in said lubricant space during drying operations.

2. Mandrel according to claim 1, characterized in that the drawing and shoulder portions are displaceable relatively to each other on a central stud and are pressed against each other by a spring bias of the order of magnitude of the axial forces exerted on the mandrel portions during the drawing operation.

3. Mandrel according to claim 2, characterized in that the drawing and shoulder portions are pressed against each other by at least one of cup springs and resilient shims.

4. Mandrel according to claim 2, characterized in that at least one of the drawing and shoulder portions is arranged for axial displacement on the stud with an exact fit giving a sealing sliding engagement.

5. Mandrel according to claim 1, characterized in that the shoulder portion consists of two or more sections lying axially in series.

6. Mandrel according to claim 5, characterized in that the sections of the shoulder portion consist of different materials.

7. Mandrel according to claim 1, characterized in that at least one of the shoulder portion and the drawing portion have a mirror-symmetrical structure with respect to their radial centre plane.

8. Mandrel according to claim 1, characterized in that the cutting edge of the drawing portion comprises a contour differing from circular form, at least some partial sections of the cutting edge being inclined to the radial centre plane of the drawing portion.

9. Mandrel according to claim 8, characterized in that the cutting edge is of undulated form.

10. Mandrel according to claim 8, characterized in that a cutting edge of the drawing portion comprises an oval form inclined with respect to the radial centre plane.

11. Mandrel according to claim 1, wherein the drawing portion includes a cutting edge, characterized in that a chamfer running at a shallow angle to the mandrel axis adjoins the cutting edge.

12. Mandrel according to claim 11, characterized in that the chamfer makes with the mandrel axis an angle between 5° and 30°.

13. Mandrel according to claim 2, characterized in that the spring bias pressing the drawing and shoulder portions against each other is adjustable.

14. A mandrel according to claim 1, wherein said movement accommodating means includes resilient means.

15. A mandrel according to claim 14, wherein said resilient means is disposed to continuously bias said shoulder portion toward said drawing portion.

16. A mandrel according to claim 1, wherein said shoulder portion has a cross-sectional dimension greater than does said drawing portion, and wherein said shoulder portion is dimensioned to continuously bear around its circumference on the inside wall of a tube being drawn during drawing operations.

17. A mandrel according to claim 12, wherein said angle is between 5° and 20°.

18. A mandrel according to claim 17, wherein said angle is between 10° and 20°.

19. A mandrel according to claim 15, wherein said resilient means is adjustable.

20. A mandrel according to claim 1, wherein the drawing and shoulder portions are displaceable relative to each other on a stud and are urged towards each other by said movement accommodating means which includes resilient means interposed between said shoulder portion and an end of said stud.

* * * * *

UNITED STATES PATENT AND TRADEMARK OFFICE

CERTIFICATE OF CORRECTION

PATENT NO. : 4,057,992

DATED : November 15, 1977

INVENTOR(S) : Bernhard Max Willimzik

It is certified that error appears in the above-identified patent and that said Letters Patent are hereby corrected as shown below:

In claim 1, last line, change "drying" to --drawing--.

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*